US008701311B2

(12) United States Patent
Barnhart

(10) Patent No.: US 8,701,311 B2
(45) Date of Patent: Apr. 22, 2014

(54) TOP OF THE BOOT

(76) Inventor: Laurel Barnhart, Riverview, FL (US)

( * ) Notice: Subject to any disclaimer, the term of this patent is extended or adjusted under 35 U.S.C. 154(b) by 521 days.

(21) Appl. No.: 13/017,188

(22) Filed: Jan. 31, 2011

(65) Prior Publication Data

US 2012/0192460 A1 Aug. 2, 2012

(51) Int. Cl.
*A43B 23/00* (2006.01)

(52) U.S. Cl.
USPC ..... 36/136; 36/1.5

(58) Field of Classification Search
USPC ..... 36/1.5, 2 R, 2 A, 2 B, 100, 101, 136
See application file for complete search history.

(56) References Cited

U.S. PATENT DOCUMENTS

| | | | | |
|---|---|---|---|---|
| 562,784 | A * | 6/1896 | Fisher | 36/2 R |
| 815,194 | A * | 3/1906 | Metz | 36/1.5 |
| 1,187,663 | A * | 6/1916 | Segal | 36/1.5 |
| 1,712,035 | A * | 5/1929 | Frykman | 36/1.5 |
| 2,028,947 | A * | 1/1936 | Palm | 36/2 R |
| 2,230,291 | A * | 2/1941 | Evans | 36/7.3 |
| 2,704,898 | A * | 3/1955 | Sleyman | 36/2 R |
| 2,729,899 | A * | 1/1956 | Haase | 36/7.1 R |
| 2,857,688 | A * | 10/1958 | Haase | 36/1 |
| 4,503,566 | A * | 3/1985 | Wheeler | 2/22 |
| 4,748,749 | A * | 6/1988 | Colvard | 36/2 R |
| 5,501,022 | A * | 3/1996 | Cohn | 36/2 R |
| 5,887,359 | A * | 3/1999 | Falguere | 36/2 R |
| 6,477,788 | B1 * | 11/2002 | Chen | 36/1.5 |
| 7,328,528 | B2 | 2/2008 | Caminiti | |
| 2005/0198872 | A1 * | 9/2005 | Correa | 36/136 |
| 2005/0278976 | A1 * | 12/2005 | Bry | 36/1 |
| 2006/0010575 | A1 | 1/2006 | Heiderer et al. | |
| 2007/0084080 | A1 * | 4/2007 | Heiderer et al. | 36/2 R |
| 2009/0188020 | A1 | 7/2009 | Beaumont | |
| 2009/0241380 | A1 * | 10/2009 | Jeffers et al. | 36/136 |
| 2010/0275465 | A1 * | 11/2010 | Reilly et al. | 36/136 |
| 2011/0308111 | A1 * | 12/2011 | Paraszczak et al. | 36/100 |
| 2012/0047773 | A1 * | 3/2012 | Schrader | 36/136 |
| 2012/0174442 | A1 * | 7/2012 | Castle | 36/136 |

* cited by examiner

*Primary Examiner* — Marie Bays
(74) *Attorney, Agent, or Firm* — Phillip Vales

(57) ABSTRACT

A tube of material comprising a decorative portion with an inner layer having an attachment member(s) inserted therein. The attachment member(s) is connected to the rim of a boot through user interaction with the boot. Various jewelry items have connection member(s) attached to the inner layer. Each of the connection member(s) is attached to another connection member and or to a decorative jewelry item. A tube comprising a decorative portion; an inner layer sewn at its border to the decorative portion; and a sock sewn to a top side of the sewn border so that it folds inwards into the sock. A connection member(s) is attached to the inner layer. Each of the connection member(s) is further attached to another connection member and or to a decorative jewelry item. The connection member(s) is from the group of: a spring activated jeweler's lock, a keychain ring and a strip of material.

20 Claims, 4 Drawing Sheets

TOP OF THE BOOT

CROSS REFERENCE TO RELATED APPLICATIONS

N/A

STATEMENT REGARDING FEDERALLY SPONSORED RESEARCH OR DEVELOPMENT

N/A

COPYRIGHT NOTICE

A portion of the disclosure of this patent document contains material that is subject to copyright protection. The copyright owner has no objection to the facsimile reproduction by anyone of the patent document or patent disclosure as it appears in the United States Patent and Trademark Office patent file or records, but otherwise reserves all copyrights whatsoever.

BACKGROUND (1) Field of the Invention

Relating to improvements in accessories for footwear. More specifically relates to improvements directed to beautifying boots.

(2) Related Art

US patent application US 2006/0010575 to Heiderer et al. teaches a tube comprising a foldable decorative tubular portion comprising an inward turned portion and an outward turned portion. The outward turned portion includes an ornamental design thereon an/or a decoration extending therefrom.

US patent application 2009 0188020 to Beaumont teaches a sock that may include a sock portion and a decorative portion. The decorative portion may be attached to the sock portion with an attachment mechanism. The decorative portion may be fur, synthetic fur, fabric or other materials. The decorative portion may include an opening and a closure for the opening. The closure may be a lace, such as, ribbon, cord, fabric, leather or other material.

The closure may also be button and loop, snaps, hook and loop closure, hook and eye, or other closure. The decorative portion may be folded over the top of the shoe. In one embodiment, the sock portion may be removably attached to the decorative portion, with an attachment mechanism. The attachment mechanism may be snaps, hook and loop closure, or other attachment mechanism. In one embodiment, the lace may include a decorative item.

There are many styles of footwear in use today. Recently, expensive footwear has crossed the line from being a necessary item to that of being a fashion statement. However, because of the cost involved many times individuals cannot afford to have the most desirable footwear. In particular, fashion boots have sizzled in the marketplace and many women (and even some men) have bought up the offerings of many designers eager to follow the latest trend. Unfortunately, following the trend in all of its manifestations is out of the reach of most people. Thus, there needs to be a mechanism of varying the appearance of boots that keeps costs down, is easy to implement and provides a broad appeal to the user.

BRIEF SUMMARY OF THE INVENTION

A first embodiment has a tube of material comprising a decorative portion; an inner layer sewn at its border to the decorative portion; and an attachment member inserted in the inner layer. In this embodiment the attachment member is a plastic clip, metallic clip, snap clip or barrette. Typically the plastic clip has an integral paper clip on its back side. In this first embodiment the attachment member is connected to the rim of a boot through user interaction with the boot and attachment member. To improve upon the connection of the attachment member to the rim of the boot multiple attachment members are used. To hold various jewelry items using the embodiment herein at least one connection member is attached to the inner layer; improving upon this idea uses one or more other connection members attached to the inner layer. Each of the connection member(s) is attached another connection member and or to a decorative jewelry item. The connection member is from the group of: a spring activated jeweler's lock, a keychain ring and a strip of material.

A second embodiment has a tube comprising a decorative portion; an inner layer sewn at its border to the decorative portion; and a sock sewn to a top side of the sewn border so that it folds inwards into the sock. A connection member is attached to the inner layer and this idea is improved upon with more connection members attached to the inner layer. Each of the connection member(s) is further attached to another connection member and or to a decorative jewelry item. The connection member(s) is from the group of: a spring activated jeweler's lock, a keychain ring and a strip of material. The one or more connection members are attached to another connection member and or to a decorative jewelry item.

A tube comprising a decorative portion having fur attached to a final layer; an inner layer sewn at its border to the decorative portion; and an connection member connected to the inner layer. The tube of has fur that is natural animal fur or manmade natural fur.

DETAILED DESCRIPTION OF THE INVENTION

Figure 1A:
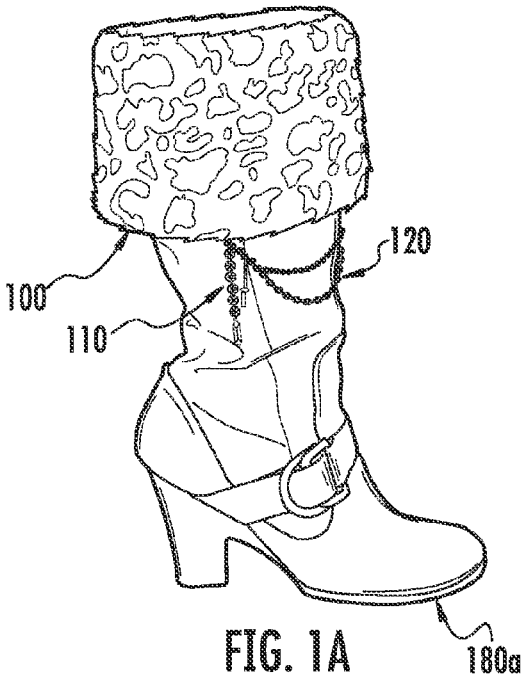
FIG. 1 illustrates various implementations of the novelties taught herein; several boots are shown having different looks showing jewelry attachments, pom-poms, boot bling and a cuff attached to a sock and a cuff attached to a boot.
Figure 1B:
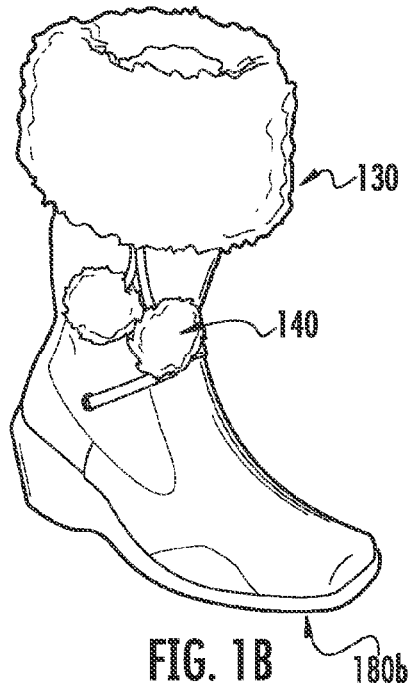
Figure 1C:
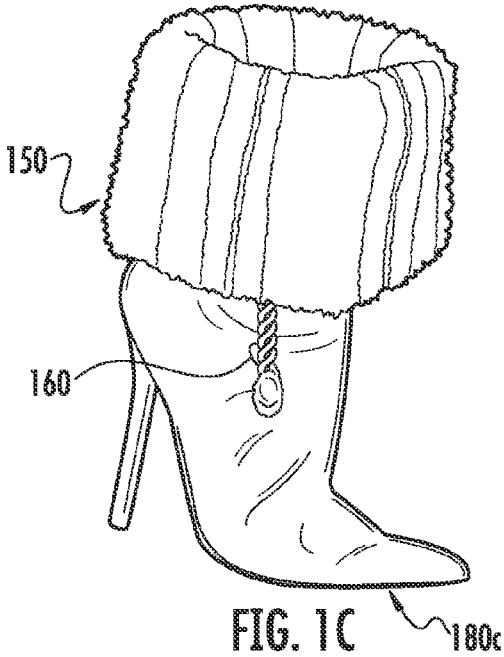
Figure 1D:
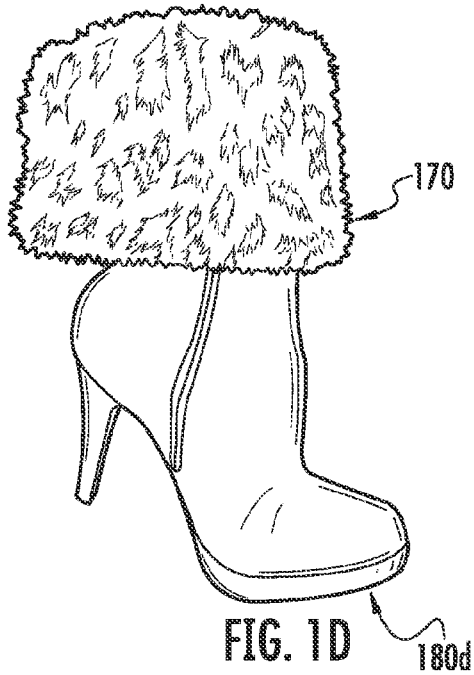

The prior art lacks several important novelties that are explained hereafter. Neither Heiderer nor Beaumont teach a simple mechanism that facilitates the easy removal and reattachment of various decorative items with or without the use of a sock. Similarly, they do not teach the easy removal of cuffs of decorative material from one or more boots using off the shelf components. Similarly, they do not teach the easy removal of decorative items from one or more boots or socks using off the shelf components. To overcome these deficiencies the following novel features are proposed in the following embodiments.

FIG. 1 illustrates various implementations of the novelties taught herein; several boots are shown having different looks showing jewelry attachments, pom-poms, boot bling and a cuff attached to a sock and a cuff attached to a boot. An external portion of the cuffs has integrated into their tubular design a piece of material that creates a pleasant appearance utilizing various furs or faux furs. Amongst the possibilities for the furs and faux furs are Design Quality Brown Mink, Design Quality White Mink, Snow Leopard, Cheetah, Zebra, Black Poodle, Brown Leopard, Black Bear, Snow Tiger, Lambswool and White bear. FIG. 1A shows a boot 180*a* having a cuff 100 attached to a boot or sock. Several pieces of jewelry 110, 120 are hung from the inner portion of the cuff 100. FIG. 1B illustrates a boot 180*b* having a cuff 130 attached to a boot or sock. Pom-poms 140 are attached to the inner portion of the cuff 130. FIG. 1C shows a boot 180*c* having a cuff 150 attached to a boot or sock. A piece of jewelry 160 is attached to the inner portion of the tubular cuff. FIG. 1D shows a boot 180*d* having a cuff 170 with no attached jewelry.

Figure 2A:
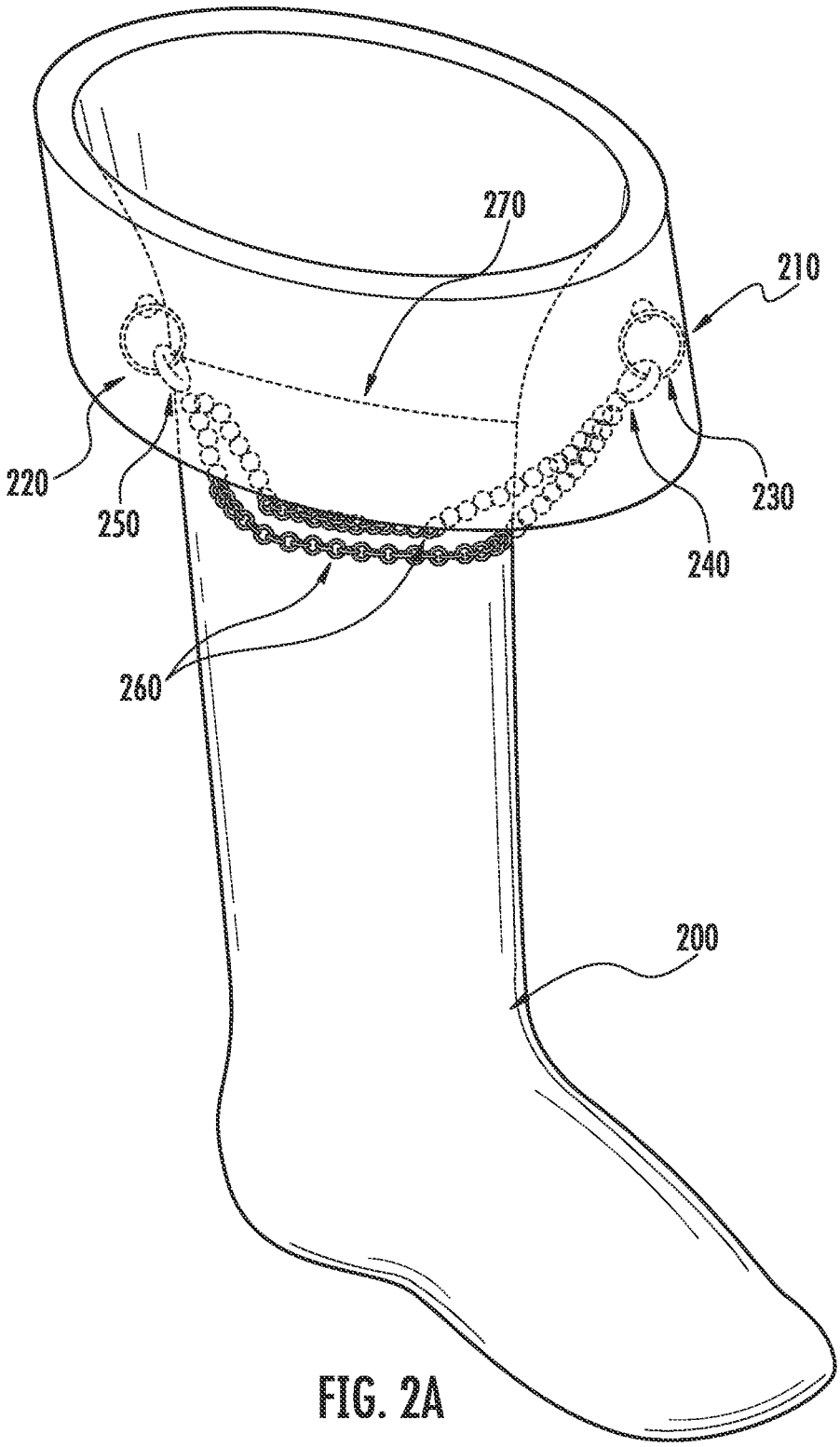
FIG. 2*a* illustrates one embodiment of the TOP OF THE BOOT novelties. A tubular cuff of material is sewn into a sock. Once a user inserts a foot into the sock it is possible for further insertion of that foot into a boot. The cuff then hangs outside providing decorative novelties.

FIG. 2*a* illustrates one embodiment in more detail of the TOP OF THE BOOT novelties. A tubular layered cuff 210 of material is sewn into a tubular sock 200 along an edge of the tubular sock 270. The sock is of a typical man made material such as cotton, Nylon, Spandex, Micro Fiber, Micro Nylon, Polyester, Tactel Nylon, Microdenier Nylon, Lycra, Lycra Spandex, Acetate, Rayon, Viscose or Chenniel. Once a user inserts a foot into the sock it is possible for further insertion of that foot into a boot. The cuff then hangs outside providing decorative novelties. The tubular cuff 210 has an associated tubular edge that matches the sewn edge of the tubular sock at 270. A set of keychain rings 220, 230 provides support for the connection of jewelry items 260 to the cuff 210. The keychain rings 220, 230 are sewn into the most inner layer portion using a scrap of material that will be further described with respect to the other embodiment and FIG. 3. Alternatively, the keychain rings 220, 230 perforate the inner layer and thus are held in place as a result of this perforation. Attached to the keychain rings 220, 230 are shown two jewelers' clasps 240, 250 that are each connected to a separate one of the rings 220, 230 utilizing the open mouth of the clasps. A user simply depresses the finger protrusion that manipulates the jeweler's spring thereby permitting the mouth of the clasp to be inserted into the ring; once one side of the clasp has passed though, a user removes the pressure thereby closing the clasp in the circle of the keychain ring. Alternatively, a user can use the keychain ring as ordinarily used to insert keys by lifting one end of the ring and inserting the mouth of the clasp there through until it sits inside of the ring in a good connection. The base of each of the clasps 240, 250 has an integral hollow loop passing there through that form a connection point for other items. Links of jewelry items are attached to these bases by the opening of a link using jeweler's tools, pliers or similar tools, the insertion of a link through the hollow loop and the re-closing of the link so as to ensure a good connection. In this manner, a jewelry item is attached to two keychain rings using two jeweler's clasp. Of course, it is not necessary to connect to two ring/clasp pairs. A single jewelry item can use a single ring/clasp pair and hang straight down as show in FIG. 1*c*. In FIG. 2*a* there is shown two items 260 connected to ring/clasp pairs. Of course, one can have a single jewelry item connected across a ring/clasp pair. Thus, in the broadest interpretation, a ring/clasp pair attached to the inner layer of a cuff can connect to one or more jewelry items that may be connected to one or more ring/clasp pairs and so on.

Figure 2B:
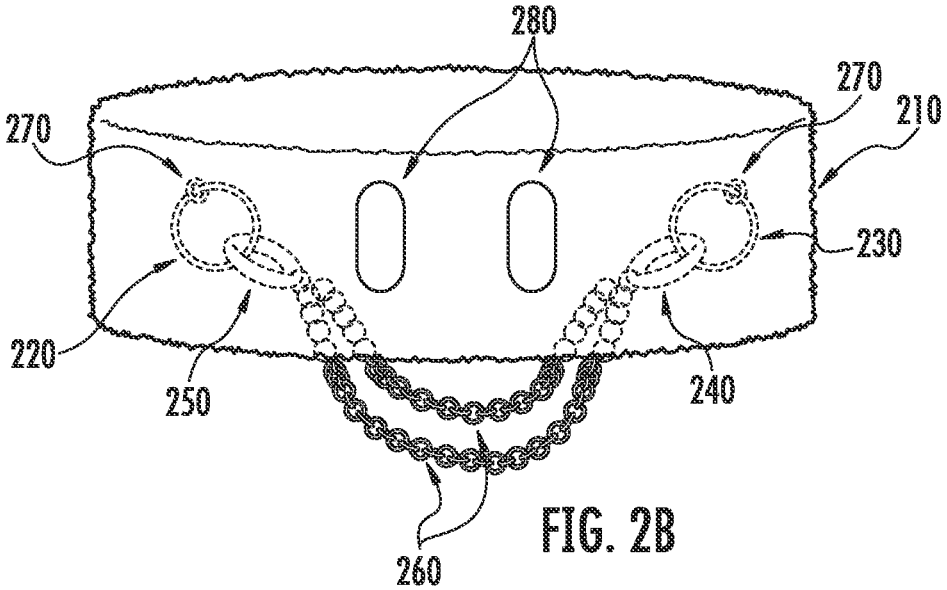
FIG. 2*b* illustrates another embodiment of the TOP OF THE BOOT novelties. A tubular cuff of material operates independently from any sock. Various attachment items are used to attach the cuff to the rim of the boot.

FIG. 2*b* illustrates another embodiment of the TOP OF THE BOOT novelties. A tubular cuff of material 210 operates independently from any sock and is NOT permanently connected to any sock. Various attachment items 280 are used to attach the cuff to the rim of a boot. The attachment members 280 are made of a plastic cover and paper clip that extends beyond the borders of the plastic cover. Each of the attachment members' 280 paper clips are inserted into the cuff member 210 through a slot opening in the inner layer of material closest to the boot. The ends of these clips are then threaded through a backing layer for the external fur of the cuff; this provides traction so that it is not easy to remove them from the cuff. A set of keychain rings 220, 230 provides support for the connection of jewelry items 260 to the cuff 210. The keychain rings 220, 230 are sewn into the most inner layer portion using a scrap of material 270 that will be further described with respect to FIG. 3. Alternatively, the keychain rings 220, 230 perforate the inner layer and thus are held in place as a result of this perforation. Attached to the keychain rings 220, 230 are shown two jewelers' clasps 240, 250 that are each connected to a separate one of the rings 220, 230 utilizing the open mouth of the clasps. A user simply depresses the finger protrusion that manipulates the jeweler's spring thereby permitting the mouth of the clasp to be inserted into the ring; once one side of the clasp has passed though, a user removes the pressure thereby closing the clasp in the circle of the keychain ring. Alternatively, a user can use the keychain ring as ordinarily used to insert keys by lifting one end of the ring and inserting the mouth of the clasp there through until it sits inside of the ring in a good connection. The base of each of the clasps 240, 250 has an integral hollow loop passing there through that form a connection point for other items. Links of jewelry items are attached to these bases by the opening of a link using jeweler's tools, pliers or similar tools, the insertion of a link through the hollow loop and the re-closing of the link so as to ensure a good connection. In this manner, a jewelry item is attached to two keychain rings using two jeweler's clasp. Of course, it is not necessary to connect to two ring/clasp pairs. A single jewelry item can use a single ring/clasp pair and hang straight down as show in FIG. 1*c*. In FIG. 2*a* there is shown two items 260 connected to ring/clasp pairs. Of course, one can have a single jewelry item or group of jewelry items connected across a ring/clasp pair or group of pairs. Thus, in the broadest interpretation, a ring/clasp pair attached to the inner layer of a cuff can connect to one or more jewelry items that may be connected to one or more ring/clasp pairs and so on. Additionally, the perforation of the inner layer, end to end sewn thread or key ring may be used with or without a clasp if a user simply ties the item with string or other mechanical connection.

Figure 2C:
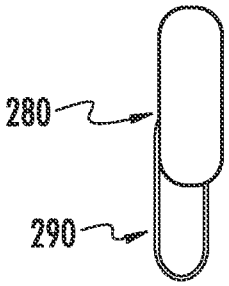
FIGS. 2*c-d* illustrates an attachment item for attaching a cuff to a rim of the boot in the second embodiment.
Figure 2D:
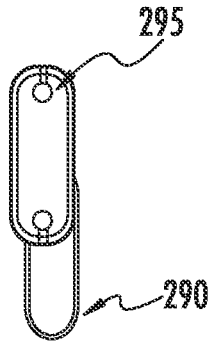

FIG. 2*c* illustrates the front side of an attachment item 280 for attaching a cuff to a rim of the boot in the second embodiment. The plastic cover of the attachment member 280 is shown having the extended paper clip 290 appearing outside the boundaries of the oblong curved plastic piece with rounded edges. The plastic cover is welded, glued and or mechanically pressed on top of a metal plate (tin, aluminum or similar metal) that matches exactly, as far as practicable, the dimensions of the plastic cover. FIG. 2*d* shows the back side of the attachment member 280 having two metal holders 295 for holding the paper clip 290 into place at the top and bottom of the oblong member 280. One end of each of the metal holders 295 is welded onto the metal plate that is glued or pressed onto the back of plastic cover. When a paper clip is presented into the proximity of these holders they are welded mechanically compressed and or glued into place thus holding the paper clip in place.

Figure 2E:
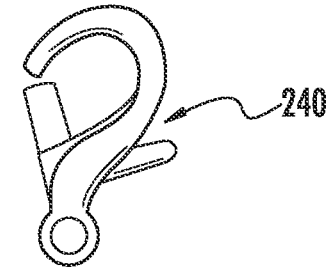
FIGS. 2*e-g* illustrates connection items for connecting decorative bling, pom-poms and other similar decorations to the inside portion of a cuff of material whether in the first or second embodiments.
Figure 2F:
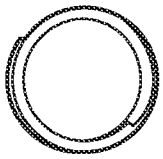
Figure 2G:
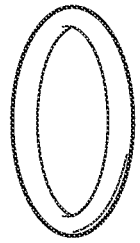

FIGS. 2*e-g* illustrates connection items for connecting decorative bling, pom-poms and other similar decorations to the inside portion of a cuff of material whether in the first or second embodiments. FIG. 2*e* shows a typical jeweler's clasp that operates by pressing the protrusion that extends out one side for user activation of the spring therein. FIG. 2*f* shows a typical keychain ring that is formed of a metal loop curled up on itself. FIG. 2*g* shows a strip of material that is turned back on itself end to end forming a loop of material that would be sewn at the ends into the inner layer of the cuff member. This loop of material (cotton, nylon, spandex, polyester, rayon or any of the other natural or manmade fibers mentioned herein) can be used in combination with the keychain ring/clasp pair as a further attachment or in lieu of one or more of the aforementioned.

Figure 3:
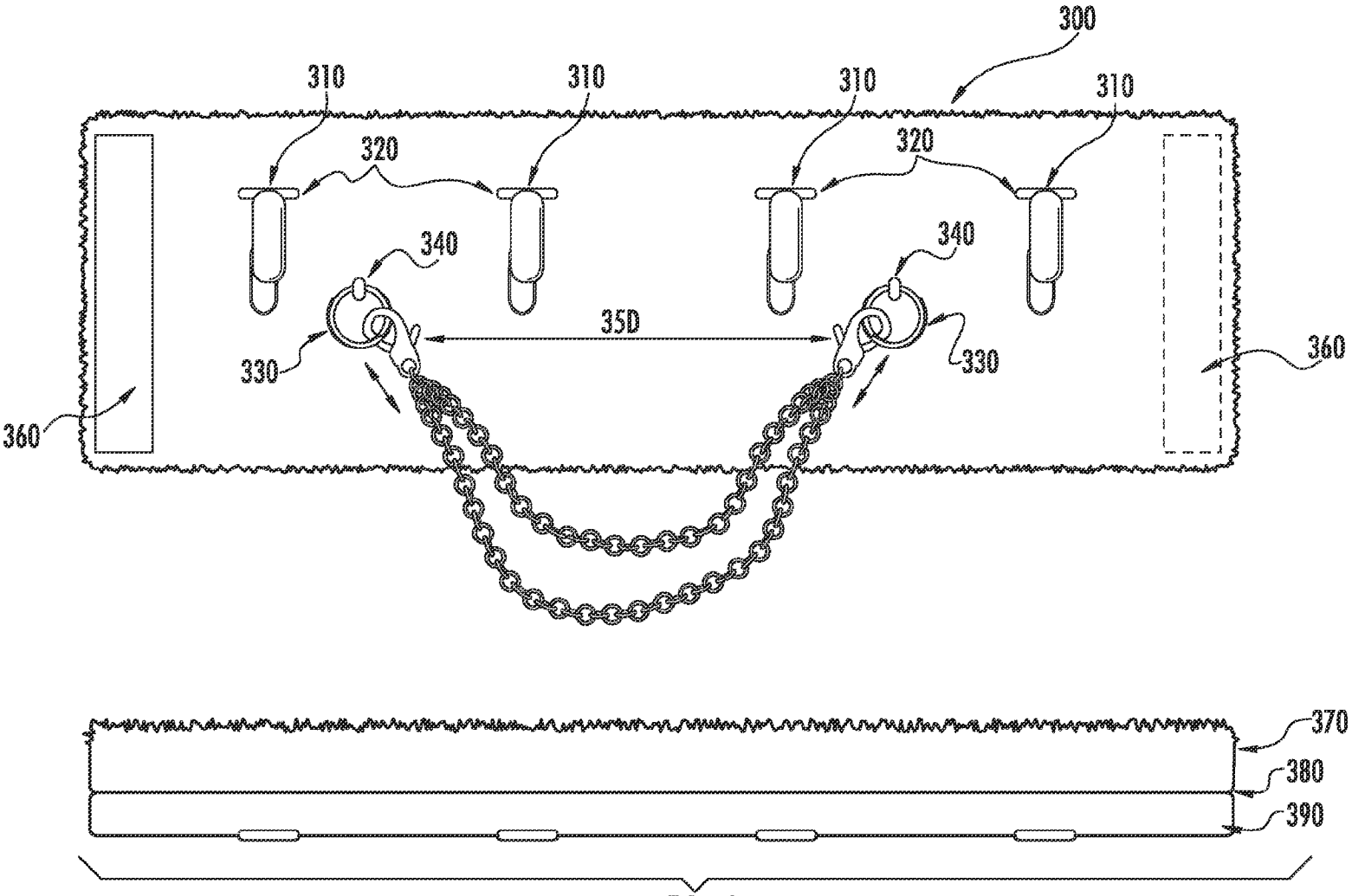
FIG. 3 describes various features of a cuff of material in a second embodiment showing optional Velcro connection for easy removal of the cuff.

FIG. 3 describes various features of a cuff 300 of material in a second embodiment showing optional Velcro 360 connection for easy removal of the cuff. The cuff is in ordinarily sewn into a single tubular member. However, there is the option of using a dual matching line 360 of loops and hooks found in the typical Velcro material arrangement; in this fashion, the material is sewn into each end of the tubular cuff 300 so as to provide easy attachment and removal of the cuff 300 from the boot of a user. Various attachment members 310 are inserted into slots 320 cut out of an inner layer 390 of material made of any of the manmade or natural fibrous clothing materials mentioned herein. The paper clip portion of the attachment member 310 is threaded back and forth into a backing layer 380 such that the paper clip is difficult to retract there from; like the other layers, the backing layer 380 is made of any of the manmade or natural clothing fibers herein described. Thus, the plastic cover portion of each of the attachment members 310 hangs inside the inner layer 390. To decorate a piece of footwear a user opens each of the plastic covers and orients them inside the edges of a piece of footwear. She would then close each of the plastic cover portions about the rim of a boot or similar footwear thus locking the cuff 300 in place so as to provide a decoration for a boot or similar footwear; the plastic covers now hang inside the boot rim. A fur layer 370 forms the topmost external layer for decorative appeal. Of course, the three layers so far described are sewn together along the edges of each of them so as to from a single unit. Further, the figure does not show a final support layer that is in physical contact with the fur and holds it in place with glues, resins or similar connective materials. Next, Keychain rings 330 are inserted either into perforations directly in the inner layer 390 or are held in place by a piece of material (made of any of the manmade or natural clothing fibers herein described previously, cotton, nylon, rayon, spandex etc. . . . ) 340 sewn over the ring with two main sewing zones on the small piece of material one on the inner side of the loop and another on the outside of the loop. Thus, the ring is held in place. The jewelers' clasps 350 and jewelry items operate in a similar fashion as described previously with respect to FIG. 2*b*. A piece of material such as shown in FIG. 2*g* may be substituted instead of the ring 330 and material 340. The new piece is sewn at its end to the inner layer of the cuff and the jeweler's clasp is inserted there through. Alternatively, strings, metal links, and or other types of clasps or connections mechanism may be substituted for the connection of jewelry items to the cuff's piece of material.

The invention has thus been described in such clear and precise terms as to enable one of ordinary skill in the art to understand its fundamental principles.

I claim:

1. A tube comprising:
a decorative portion;
an inner layer sewn at its border to the decorative portion;
a customizable jewelry connection member attached to the inner layer and
an attachment member inserted in the inner layer.

2. The tube of claim 1, wherein the attachment member is a plastic clip.

3. The tube of claim 2, wherein the plastic clip has an integral paper clip on its back side.

4. The tube of claim 1, wherein the attachment member is in contact with the rim of a boot through user interaction with the boot and attachment member.

5. The tube of claim 1, further comprising:
one or more other attachment members.

6. The tube of claim 1,
wherein the tube is a strip of material having an attached inner layer such that the tube is from the set comprising: a strip sewn end to end, and a strip attached by velcro into a tubular shape.

7. The tube of claim 6, further comprising:
one or more other jewelry connection members attached to the inner layer.

8. The tube of claim 6, where the connection member is attached to either of another connection member or to a decorative jewelry item.

9. The tube of claim 6, wherein the connection member is from the group of: a spring activated jeweler's lock, a keychain ring and a strip of material.

10. The tube of claim 7, wherein the one or more other connection members are from the group of: a spring activated jeweler's lock, a keychain ring and a strip of material.

11. A tube comprising:
a decorative portion;
an inner layer sewn at its border to the decorative portion;
a customizable jewelry connection member attached to the inner layer and
a sock sewn to a top side of the sewn border so that it folds inwards into the sock.

12. The tube of claim 11, further comprising:
a a plurality of jewelry connection member attached to the inner layer.

13. The tube of claim 11, further comprising:
a plurality of jewelry connection members attached to the inner layer.

14. The tube of claim 11, where the connection member is attached to either of another connection member or to a decorative jewelry item.

15. The tube of claim 11, wherein the connection member is from the group of: a spring activated jeweler's lock, a keychain ring and a strip of material.

16. The tube of claim 13, wherein the one or more other connection members are from the group of: a spring activated jeweler's lock, a keychain ring and a strip of material.

17. The tube of claim 13, where the one or more connection members are attached to either of another connection member or to a decorative jewelry item.

18. A tube comprising:
a decorative portion having fur attached to a final layer;
an inner layer sewn at its border to the decorative portion; and
customizable jewelry connection member connected to the inner layer.

19. The tube of claim 18, wherein the fur is natural animal fur.

20. The tube of claim 18, wherein the fur is manmade animal fur.

* * * * *